US009378672B2

(12) United States Patent
Chong et al.

(10) Patent No.: US 9,378,672 B2
(45) Date of Patent: Jun. 28, 2016

(54) ORGANIC LIGHT EMITTING DISPLAY DEVICE AND DRIVING METHOD THEREOF

(71) Applicants: Jong-Ho Chong, Yongin (KR); Seung-Bae Lee, Yongin (KR); Hun-Jung Lee, Yongin (KR); Su-Young Kim, Yongin (KR); Hye-Ryoung Park, Yongin (KR)

(72) Inventors: Jong-Ho Chong, Yongin (KR); Seung-Bae Lee, Yongin (KR); Hun-Jung Lee, Yongin (KR); Su-Young Kim, Yongin (KR); Hye-Ryoung Park, Yongin (KR)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 165 days.

(21) Appl. No.: 13/732,659

(22) Filed: Jan. 2, 2013

(65) Prior Publication Data

US 2013/0321364 A1 Dec. 5, 2013

(30) Foreign Application Priority Data

Jun. 1, 2012 (KR) ..... 10-2012-0059118

(51) Int. Cl.

| | |
|---|---|
| ***G09G 5/00*** | (2006.01) |
| ***G09G 3/32*** | (2016.01) |
| ***G09G 3/00*** | (2006.01) |

(52) U.S. Cl.

CPC ..... *G09G 3/3208* (2013.01); *G09G 3/003* (2013.01); *G09G 3/3233* (2013.01); *G09G 2310/061* (2013.01)

(58) Field of Classification Search

CPC . G09G 2310/061; G09G 5/10; G09G 3/3208; G09G 3/003; G09G 3/3233

USPC ..... 345/76, 204, 419, 690; 348/51, 56; 359/462

See application file for complete search history.

(56) References Cited

U.S. PATENT DOCUMENTS

| | | | | |
|---|---|---|---|---|
| 2011/0007140 | A1* | 1/2011 | Nakahata et al. | 348/56 |
| 2011/0116166 | A1* | 5/2011 | Jung et al. | 359/465 |
| 2011/0134166 | A1* | 6/2011 | Shirasaki et al. | 345/690 |
| 2011/0205346 | A1* | 8/2011 | Taniguchi | 348/56 |
| 2011/0216173 | A1* | 9/2011 | Gilson | 348/54 |
| 2012/0182408 | A1* | 7/2012 | Kotani et al. | 348/56 |
| 2013/0038520 | A1* | 2/2013 | Osman | 345/156 |

FOREIGN PATENT DOCUMENTS

| | | | |
|---|---|---|---|
| KR | 10-2010-0017725 | A | 2/2010 |
| KR | 10-2011-0107582 | A | 10/2011 |

* cited by examiner

*Primary Examiner* — Kent Chang
*Assistant Examiner* — Mark Edwards
(74) *Attorney, Agent, or Firm* — Lee & Morse, P.C.

(57) ABSTRACT

An organic light emitting display device includes pixels at intersection regions of scan and data lines, a scan driver configured to supply a scan signal to the scan lines, a data driver configured to supply a data signal to the data lines, and a timing controller configured to receive from outside frame data including left and right image data, and to insert first blank periods into initial and latter periods of a same frame, the left and right image data being between the initial and latter periods of the same frame.

20 Claims, 4 Drawing Sheets

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2012-0059118, filed on Jun. 1, 2012, in the Korean Intellectual Property Office, and entitled: "Organic Light Emitting Display Device and Driving Method Thereof," the entire content of which is incorporated herein by reference.

BACKGROUND

1. Field

An aspect of example embodiments relates to an organic light emitting display device and a driving method thereof, and more particularly, to an organic light emitting display device with an improved display quality and a driving method thereof.

2. Description of the Related Art

Recently, there have been developed various types of flat panel display devices with reduced weight and volume, e.g., as compared to cathode ray tubes. The flat panel display devices include, e.g., a liquid crystal display, a field emission display, a plasma display panel, an organic light emitting display device, and the like.

Among these flat panel display devices, the organic light emitting display device displays images using organic light emitting diodes that emit light through recombination of electrons and holes. The organic light emitting display device has a fast response speed and is driven with low power consumption.

The organic light emitting display device has a plurality of pixels arranged in a matrix form at intersection portions of a plurality of data lines, a plurality of scan lines, and a plurality of power lines. Each of the pixels is generally composed of two or more transistors including an organic light emitting diode and a driving transistor and one or more capacitors.

In the organic light emitting display device, one frame period may be divided into two fields so as to implement a 3D image. During the one frame period, a left image is displayed in a first field and a right image is displayed in a second field. Shutter glasses receive light through a left glass during the first field, and receive light through a right glass during the second field. In this case, a person wearing shutter glasses recognizes images supplied through the shutter glasses as 3D images.

SUMMARY

Embodiments provide an organic light emitting display device with improved display quality and a driving method thereof.

According to an aspect of the example embodiments, there is provided an organic light emitting display device including pixels at intersection regions of scan and data lines, a scan driver configured to supply a scan signal to the scan lines, a data driver configured to supply a data signal to the data lines, and a timing controller configured to receive from outside frame data including left and right image data, and to insert first blank periods into initial and latter periods of a same frame, the left and right image data being between the initial and latter periods of the same frame.

The data driver may be configured to generate the data signal using data supplied from the timing controller.

The first blank period may be a period in which an image of black is expressed.

The timing controller may be further configured to insert a second blank period between the left and right image data in the same frame.

The second blank period may be shorter than the first blank period.

The timing controller may place the right image data corresponding to a main focus prior to the left image data in the frame.

The right image data may be set to be displayed for a longer period than the left image data.

The timing controller may be further configured to insert a second blank period shorter than the first blank period between the right and left image data in the frame.

The timing controller may be configured to control a driving frequency, each of the left and right image data including the first blank period being displayed in the pixels.

According to another aspect of the example embodiments, there is also provided a driving method of an organic light emitting display device having pixels at intersection regions of scan and data lines, a scan driver supplying a scan signal to the scan lines, a data driver supplying a data signal to the data lines, and a timing controller, the method including receiving from outside frame data including left and right image data, and inserting first blank periods into initial and latter periods of a same frame, the left and right image data being between the initial and latter periods of the same frame.

Inserting the first blank period may include expressing an image of black.

The method may further include additionally inserting a second blank period between the left and right image data in the frame.

The second blank period may be shorter than the first blank period.

The right image data corresponding to a main focus may be placed prior to the left image data in the frame.

The right image data may be set to be displayed for a longer period than the left image data.

BRIEF DESCRIPTION OF THE DRAWINGS

The accompanying drawings, together with the specification, illustrate exemplary embodiments of the example embodiments, and, together with the description, serve to explain the principles of the example embodiments.

DETAILED DESCRIPTION

Figure 1A:
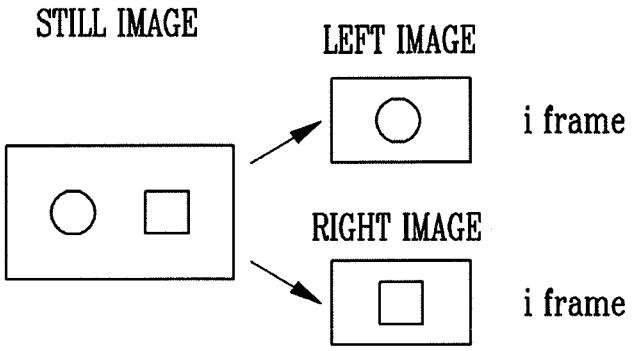
FIGS. 1A and 1B are diagrams of pairs of images recognized as still and moving images, respectively.

Korean Patent Application No. 10-2012-0059118, filed on Jun. 1, 2012, in the Korean Intellectual Property Office, and entitled: "Organic Light Emitting Display Device and Driving Method Thereof" is incorporated by reference herein in its entirety.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
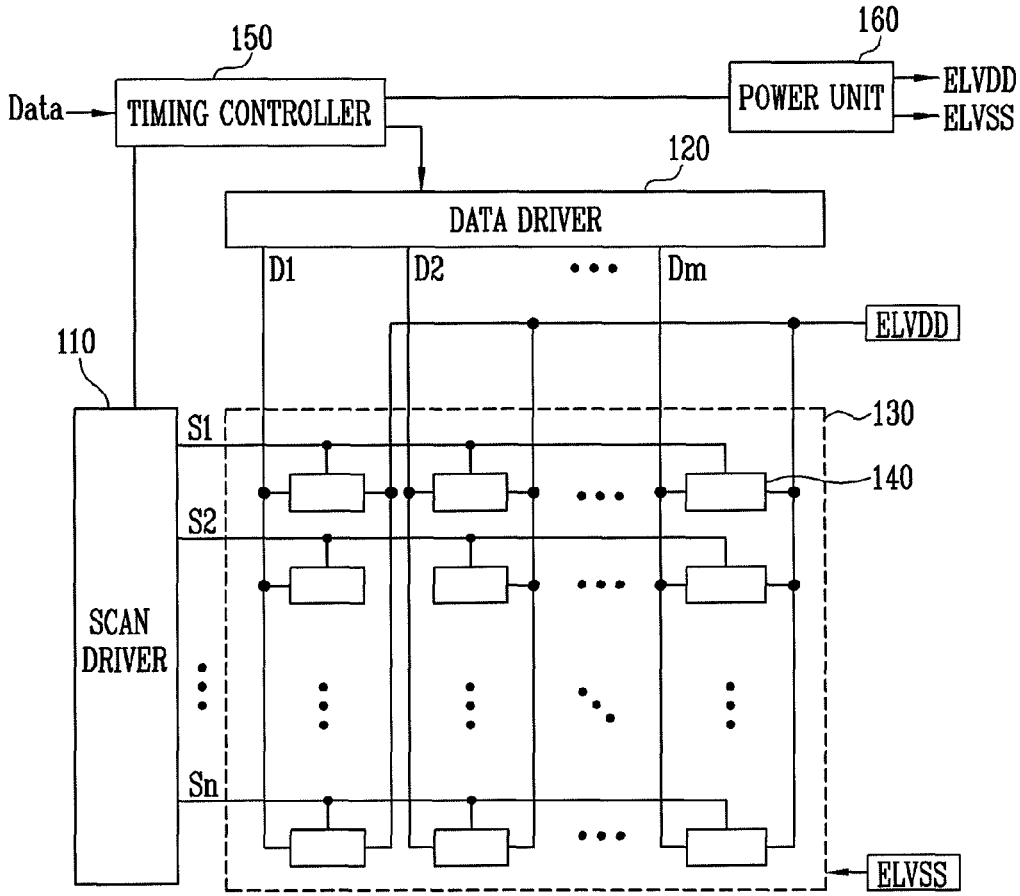
FIG. 2 is a block diagram showing an organic light emitting display device according to an embodiment.

FIG. 2 is a block diagram showing an organic light emitting display device according to an embodiment.

Referring to FIG. 2, the organic light emitting display device according to this embodiment includes a pixel unit having pixels 140 positioned at intersection portions of scan lines S1 to Sn and data lines D1 to Dm, a scan driver 110 for driving the scan lines S1 to Sn, a data driver 120 for driving the data lines D1 to Dm, a power unit 160 for generating first power ELVDD and second power ELVSS supplied to the pixels 140, and a timing controller 150 for controlling the scan driver 110, the data driver 120, and the power unit 160.

The pixels 140 receive the first power ELVDD and the second power ELVSS supplied from the power unit 160. Each of the pixels 140 generates light with a predetermined luminance while controlling the amount of current that flows from the first power ELVDD to the second power ELVSS via an organic light emitting diode (OLED).

The power unit 160 generates the first power ELVDD and the second power ELVSS and supplies the generated power to the pixels 140.

The timing controller 150 controls the scan driver 110, the data driver 120, and the power unit 160. The timing controller 150 changes data Data input from the outside thereof and provides the changed data to the data driver 120. To this end, the timing controller 150 may further include a frame memory (not shown). A detailed operating process of the timing controller 150 will be described later.

The scan driver 110 supplies a scan signal to the scan lines S1 to Sn. If the scan signal is supplied to the scan lines S1 to Sn, pixels 140 for each line are selected.

The data driver 120 generates a data signal using the data Data supplied from the timing controller 150, and supplies the generated data signal to the data lines D1 to Dm in synchronization with the scan signal. The data signal supplied to the data lines D1 to Dm is input to the pixels 140 selected by the scan signal.

Figure 3:
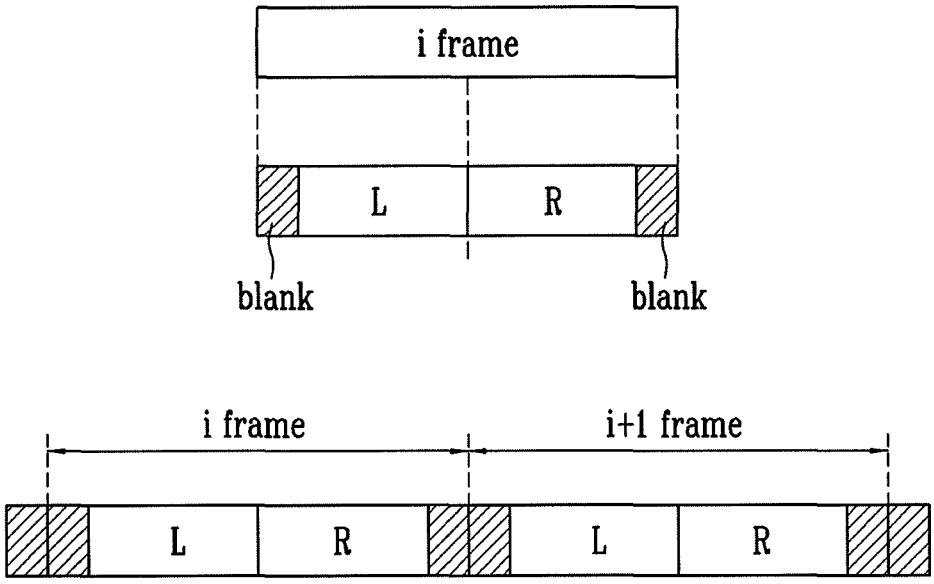
FIG. 3 is a diagram showing an operating process of a timing controller according to a first embodiment.

FIG. 3 is a diagram showing an operating process of a timing controller according to a first embodiment. Referring to FIGS. 2-3, the timing controller 150 receives data for each frame, i.e., that is input from the outside thereof. For example, the timing controller 150 receives a left (L) image corresponding to a first field in one frame and a right (R) image corresponding to a second field in the one frame, supplied from the outside.

The timing controller 150 receiving the data for each frame inserts blank periods respectively into an initial period and a latter period in the one frame (i frame), e.g., the timing controller 150 inserts a blank period in the beginning of a frame and at the end of the same frame. For example, the timing controller 150 may insert a blank period in which black is expressed (e.g., inserting black data) into each of the initial and latter periods in the one frame (i frame).

Figure 4:
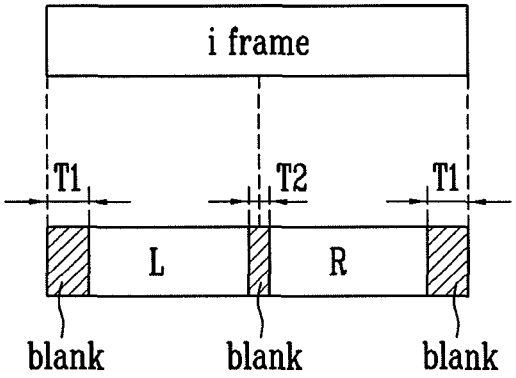
FIG. 4 is a diagram showing an operating process of the timing controller according to a second embodiment.

For example, the left (L) and right (R) images in a same frame are positioned between the blank periods that correspond to the beginning and end of the same frame. That is, the left (L) and right (R) images of a same frame are between two blank periods, as illustrated in FIG. 4. Therefore, a right (R) image positioned in an i frame and a left (L) image positioned in an (i+1) frame are separated by a blank, i.e., two blank periods corresponding to the end of the i frame and the beginning of the i+1 frame. If the right (R) and left (L) images in the different, e.g., sequential, frames are separated by a blank, as described above, it is possible to prevent the images in the different frames from being recognized as a single 3D image. In other words, a viewer recognizes left (L) and right (R) images positioned adjacent to each other in a same frame as one 3D image, and recognizes left (L) and right (R) images of different frames as separated images due to the blank. Accordingly, it is possible to improve the display quality of the 3D image.

Meanwhile, the timing controller 150 controls a frequency, so that blank information and image information (L and R) can all be expressed during the one frame period. For example, the timing controller 150 may control a driving frequency so that the image of data is expressed at a frequency higher than an input frequency.

FIG. 4 is a diagram showing an operating process of the timing controller according to a second embodiment. In the description of FIG. 4, detailed descriptions of components identical to those of FIG. 3 will be omitted.

Referring to FIG. 4, the timing controller 150 receives data for one frame (including left (L) and right (R) images), i.e., which are input from the outside. The timing controller 150 receiving the data for the one frame inserts a first blank period, e.g., black, into each of the initial and latter periods in a frame (i frame), and inserts a second blank period, black, between the left (L) and right (R) images within the same frame (i frame).

Here, a width T2 of the second blank period inserted between the left (L) and right (R) images is set to be shorter than a width T1 of the first blank period inserted into each of the initial and latter periods in the frame (i frame). In this case, it is possible to prevent left (L) and right (R) images in different frames from being recognized as one image by the first blank period inserted in each of the initial and latter periods in the one frame. Further, if the second blank period is inserted between the left (L) and right (R) images, a motion blur phenomenon can be improved, thereby displaying a dynamic image.

Meanwhile, the timing controller 150 controls a frequency so that blank information and image information (L and R) can all be expressed during one frame period. For example, the timing controller 150 may control a driving frequency so that the image of data is expressed at a frequency higher than an input frequency.

Figure 5:
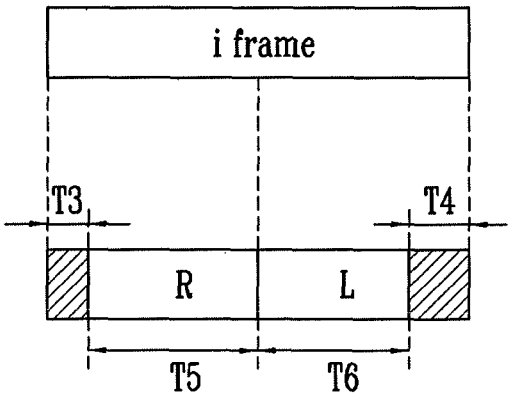
FIG. 5 is a diagram showing an operating process of the timing controller according to a third embodiment.

FIG. 5 is a diagram showing an operating process of the timing controller according to a third embodiment. Referring to FIG. 5, the timing controller 150 receives data for one frame (including left (L) and right (R) images), i.e., which is input from the outside. The timing controller 150 receiving the data for the one frame places the right (R) and left (L) images in accordance to a viewer's main focus.

For example, in over 90% of viewers, the right eye is generally used as the main focus. Therefore, the timing controller 150 places data in the order of an image corresponding to the main focus and the other image in one frame. In other words, the timing controller 150 organizes the data in the order of the right (R) image and the left (L) image in the frame, i.e., right (R) image before the left (L) image. Here, the timing controller 150 controls the right (R) image used as the main focus to be displayed during a fifth period T5, and controls the left (L) image to be displayed during a sixth period T6 that is shorter than the fifth period T5. To this end, the timing controller 150 inserts a blank period into the initial period in the frame during a third period T3, and inserts a blank period into the latter period in the frame during a fourth period T4 longer than the third period T3.

Meanwhile, in a case where the right (R) image as the main focus is displayed for a longer period than the left (L) image, it is possible to prevent right (R) and left (L) images in different frames from being recognized as one image. In other words, the viewer recognizes the left (L) image immediately continued from the right (R) image as one image, and accordingly, it is possible to improve display quality. Additionally, it is possible to prevent the right (R) and left (L) images in the different frames from being recognized as one image by the blank period inserted into each of the initial and latter periods in the frame (i frame).

Figure 6:
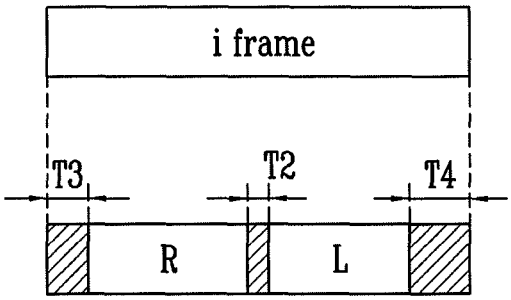
FIG. 6 is a diagram showing an operating process of the timing controller according to a fourth embodiment.

In the example embodiments, the motion blur phenomenon can be improved by inserting a blank period between the right (R) and left (L) images as shown in FIG. 6. In this case, the right (R) image as the main focus is set to be displayed for a longer period than the left (L) image.

Meanwhile, the timing controller 150 controls a frequency so that blank information and image information (L and R) can all be expressed during one frame period. For example, the timing controller 150 may control a driving frequency so that the image of data is expressed at a frequency higher than an input frequency.

In the organic light emitting display device and the driving method thereof according to the example embodiments, it may be possible to prevent images in previous and current frames from being recognized as one image by inserting blank periods in initial and latter periods of one frame, e.g. of each frame. Further, it may be possible to improve a motion blur phenomenon by inserting a blank period between right and left images included in a same frame.

Figure 1B:
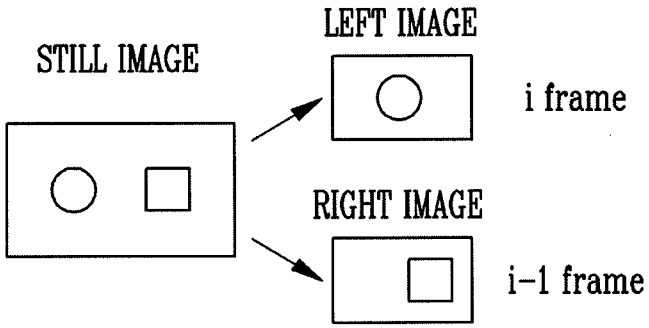

In contrast, in a conventional display device, in scrolled 3D images and 3D moving images, the right image in a previous frame and the left image in a current frame may be recognized as one image, thereby distorting the 3D depth of the recognized image. For example, when a still image is displayed as shown in FIG. 1A, the left and right images in a current frame (i frame) are recognized as one image, so that a desired 3D image can be displayed. However, when a moving image is displayed as shown in FIG. 1B, the right image in the previous frame (i−1 frame) and the left image in the current frame (i frame) may be recognized as one image at a specific time, images in previous and current frames may be continuously recognized as one image in subsequent frames, thereby reducing quality of 3D images.

While the example embodiments has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:
pixels at intersection regions of scan and data lines;
a scan driver to supply a scan signal to the scan lines;
a data driver to supply a data signal to the data lines; and
a timing controller to receive frame data including left and right image data, and to insert first blank periods into respective first and second periods of a same frame, the left and right image data are to be displayed between the first and second periods of the same frame, wherein the first period is at a beginning of the same frame and the second period is at an end of the same frame, wherein a duration of the first blank period in the first period is different from a duration of the first blank period in the second period, wherein the first blank period during the first period of the same frame is a same period for all of the pixels and wherein the first blank period during the second period of the same frame is a same period for all the pixels, and wherein same image data is applied to all the pixels in each of the first blank periods.

2. The organic light emitting display device according to claim 1, wherein the data driver is to generate the data signal using data supplied from the timing controller.

3. The organic light emitting display device according to claim 1, wherein the same image data is black image data.

4. An organic light emitting display device, comprising:
pixels at intersection regions of scan and data lines;
a scan driver to supply a scan signal to the scan lines;
a data driver to supply a data signal to the data lines; and
a timing controller to receive frame data including left and right image data, and to insert first blank periods into respective first and second latter periods of a same frame, the left and right image data are to be displayed between the first and second periods of the same frame, wherein the first period is at a beginning of the same frame and the second period is at an end of the same frame, wherein the first blank period during the first period of the same frame is a same period for all of the pixels and wherein the first blank period during the second period of the same frame is a same period for all the pixels, wherein same image data is applied to all the pixels in each of the first blank periods, and wherein the timing controller is to insert a second blank period between the left and right image data in the same frame, and wherein the second blank period is different from the first blank period.

5. The organic light emitting display device according to claim 4, wherein the second blank period is shorter than the first blank period.

6. The organic light emitting display device according to claim 1, wherein the timing controller places the right image data corresponding to a main focus prior to the left image data in the frame.

7. The organic light emitting display device according to claim 6, wherein the right image data is set to be displayed for a longer period than the left image data.

8. The organic light emitting display device according to claim 1, wherein the timing controller is to control a driving frequency, each of the left and right image data including the first blank period being displayed in the pixels.

9. A driving method of an organic light emitting display device, the method comprising:
receiving frame data including left and right image data; and
inserting first blank periods into first and second latter periods of a same frame, the left and right image data are to be displayed between the first and second periods of the same frame, wherein the first period is at a beginning of the same frame and the second period is at an end of the same frame, wherein a duration of the first blank period in the first period is different from a duration of the first blank period in the second period, wherein the first blank period during the first period of the same frame is a same period for all of the pixels of the display device, wherein the first blank period during the second period of the same frame is a same period for all the pixels in the display device, and wherein same image data is applied to all the pixels in each of the first blank periods.

10. The method according to claim 9, wherein the same image data is black image data.

11. A driving method of an organic light emitting display device, the method comprising:

receiving frame data including left and right image data;

inserting first blank periods into first and second latter periods of a same frame, the left and right image data are to be displayed between the first and second periods of the same frame; and additionally inserting a second blank period between the left and right image data in the frame, wherein the first period is at a beginning of the same frame and the second period is at an end of the same frame, wherein the second blank period is different from the first blank period, wherein the first blank period during the first period of the same frame is a same period for all of the pixels of the display device, wherein the first blank period during the second period of the same frame is a same period for all the pixels in the display device, and wherein same image data is applied to all the pixels in each of the first blank periods.

12. The method according to claim 11, wherein the second blank period is shorter than the first blank period.

13. The method according to claim 9, wherein the right image data corresponding to a main focus is placed prior to the left image data in the frame.

14. The method according to claim 13, wherein the right image data is set to be displayed for a longer period than the left image data.

15. The organic light emitting display device according to claim 1, wherein:

the left image data is to be displayed in a third period, second image data is to be displayed in a second fourth period, and a duration of the third period is different from a duration of the fourth period.

16. The organic light emitting display device according to claim 4, wherein the second blank period is shorter than the first blank period.

17. The organic light emitting display device according to claim 4, wherein a duration of the second blank period is different from the durations of the first blank periods in the first and second periods.

18. The method according to claim 9, wherein:

the left image data is to be displayed in a third period, second image data is to be displayed in a fourth period, and a duration of the third period is different from a duration of the fourth period.

19. The method according to claim 11, wherein the second blank period is shorter than the first blank period.

20. The method according to claim 11, wherein a duration of the second blank period is different from the durations of the first blank periods in the first and second periods.

* * * * *